US005457964A

United States Patent [19]

Hyde

[11] Patent Number: 5,457,964

[45] Date of Patent: Oct. 17, 1995

[54] SUPERHEAT SUPPRESSION BY LIQUID INJECTION IN CENTRIFUGAL COMPRESSOR REFRIGERATION SYSTEMS

[76] Inventor: Robert E. Hyde, 18448 SE. Pine St., Portland, Oreg. 97233-4859

[21] Appl. No.: 248,576

[22] Filed: May 24, 1994

Related U.S. Application Data

[63] Continuation of Ser. No. 128,998, Sep. 29, 1993, which is a continuation-in-part of Ser. No. 948,300, Sep. 21, 1992, Pat. No. 5,291,744, which is a division of Ser. No. 666,251, Mar. 8, 1991, Pat. No. 5,150,580.

[51] Int. Cl.[6] ..... F25B 9/00

[52] U.S. Cl. ..... 62/86; 62/DIG. 17; 62/DIG. 2; 62/197; 62/196.3; 62/513; 62/498

[58] Field of Search ..... 62/197, 196.3, 62/196.4, DIG. 2, DIG. 17, 498, 175, 335

[56] References Cited

U.S. PATENT DOCUMENTS

| | | | |
|---|---|---|---|
| 1,946,328 | 2/1934 | Neff | 62/DIG. 2 |
| 2,967,410 | 1/1961 | Schultze | 62/511 |
| 4,419,865 | 12/1983 | Szymaszek | 62/DIG. 2 |
| 4,599,873 | 7/1986 | Hyde | 62/498 |
| 5,097,677 | 3/1992 | Holtzapple . | |

FOREIGN PATENT DOCUMENTS

| | | | |
|---|---|---|---|
| 0247963 | 1/1987 | Germany | 62/DIG. 2 |

*Primary Examiner*—John M. Sollecito
*Attorney, Agent, or Firm*—Marger, Johnson, McCollom & Stolowitz

[57] ABSTRACT

This invention is a low pressure refrigeration or air-conditioning system comprising a compressor, a condenser and an evaporator interconnected in series in a closed loop for circulating refrigerant therethrough, and an improved subcircuit including a subcooler and centrifugal pump connected in series to recycle a portion of the liquid refrigerant from the condenser outlet back to the condenser inlet to desuperheat compressed refrigerant vapors. The subcooler receives a portion of the condensed liquid refrigerant from the outlet of the condenser at condenser outlet temperature and lowers that temperature by an increment of temperature, typically about 2°–3° F., to a temperature sufficiently lower than the condenser outlet temperature to prevent flashing of the refrigerant in the pump intake. The centrifugal pump receives the subcooled second portion of condensed liquid refrigerant and boosts its pressure by a pressure increment, typically 5–12 psi, to an injection pressure higher than the pressure of the compressed refrigerant vapor. The condensed and pressure-boosted liquid refrigerant is discharged from the pump into the condenser, or upstream thereof, to vaporize and cool the superheated vapor refrigerant to a reduced temperature, thereby reducing the vapor refrigerant to a saturated condition. The system can be a centrifugal compressor type system with a float valve gating refrigerant flow from the condenser, which is at one to two atmospheres, into the evaporator, which is at about one-half an atmosphere.

19 Claims, 5 Drawing Sheets

SUPERHEAT SUPPRESSION BY LIQUID INJECTION IN CENTRIFUGAL COMPRESSOR REFRIGERATION SYSTEMS

RELATED APPLICATION DATA

This application is a continuation of application Ser. No. 08/128,998, filed Sep. 29, 1993, now abandoned which is a continuation-in-part of U.S. Ser. No. 07/948,300, filed Sep. 21, 1992 now U.S. Pat. No. 5,291,744, which is a division of U.S. Ser. No. 07/666,251, filed Mar. 8, 1991, now U.S. Pat. No. 5,150,580, issued Sep. 29, 1992.

BACKGROUND OF THE INVENTION

This invention relates generally to refrigeration and air conditioner operation and more particularly to a method and apparatus for boosting the cooling capacity and efficiency of refrigeration and air-conditioning systems under a wide range of ambient atmospheric conditions.

In air conditioning, the basic circuit is essentially the same as in many refrigeration systems. It comprises an evaporator, a condenser, an expansion valve or a float valve, and a compressor. This, however, is where the similarity ends. The evaporator and condenser of an air conditioner will generally have less surface area. The temperature difference $\Delta T$ between condensing temperature and ambient temperature is usually 27° F. with a 105° F. minimum condensing temperature, while in refrigeration the difference $\Delta T$ can be from 8° F. to 15° F. with an 86° F. minimum condensing temperature. Another difference exists in the types of compressors and refrigerants that are used. Smaller systems typically use positive displacement-type compressors with capacities up to about 3,000 intake cubic feet per minute (ICFM). Larger systems use centrifugal-type compressors, with capacities from a few thousand to over 100,000 ICFM. See "Compressor Selection for the Chemical Process Industries," *Chemical Engineering*, pp. 78–94, Jan. 20, 1975. Centrifugal compressor-type systems typically operate at lower system pressures than positive displacement-type systems.

I have previously improved the cooling capacity and efficiency of refrigeration systems of the type that use a positive displacement compressor and expansion valve. As disclosed in my U.S. Pat. No. 4,599,873, this is accomplished by addition of a centrifugal liquid pump at the outlet of the receiver or condenser. Operation of the pump typically adds 5–12 p.s.i. of pressure to the condensed refrigerant flowing into the expansion valve, a process I call liquid pressure amplification. This increment of pressure added by the centrifugal pump suppresses flash gas and assures a uniform flow of liquid refrigerant to the expansion valve, substantially increasing cooling capacity and efficiency. The best results are obtained in a floating head system operated with the condenser at moderate ambient temperatures, usually under 80° F. As ambient temperatures rise above the minimum condensing temperature, the advantages gradually decrease. The same thing happens when the principles of my prior invention are applied to air conditioning, except that the minimum condensing temperature is higher.

My prior U.S. Pat. No. 5,180,580 discloses a way to further improve upon the U.S. Pat. No. 4,599,873. By having the liquid pump feed a fraction of the pressure-augmented refrigerant to the inlet of the condenser, that invention extends the advantages of liquid pressure amplification to higher ambient temperature conditions. This specification includes the detailed description of this improvement with reference to FIGS. 3–5. I had thought that the basic principles of this patent could be readily extended to centrifugal compressor-type systems, by positioning the liquid refrigerant pump in a branch line from the condenser outlet to the condenser inlet, but that proved not to be practical.

Holtzapple U.S. Pat. No. 5,097,677 describes a method for refrigeration and air conditioning whereby refrigerant vapors are desuperheated by recycling liquid refrigerant from the condenser outlet back to the compressor outlet. In one embodiment (FIGS. 6 and 7), Holtzapple discloses spray injection of liquid refrigerant into the centrifugally-compressed refrigerant gas stream to suppress superheat, but does not identify the means by which the liquid refrigerant is input to the spray injector. FIG. 8*a* of the Holtzapple patent illustrates recycling of a portion of the liquid refrigerant back to the outlet of a reciprocating or positive displacement compressor using what Holtzapple calls a conventional hydraulic pump.

Holtzapple projects an improvement in refrigeration performance of these and other systems in a series of three theoretical papers published in ASHRAE Transactions 1989, V.95, Pt. 1, entitled "Reducing Energy Costs in Vapor-Compression Refrigeration and Air Conditioning Using Liquid Recycle—Part I: Comparison of Ammonia and R-12" (No. 3221); "Reducing Energy Costs in Vapor-Compression Refrigeration and Air Conditioning Using Liquid Recycle—Part II: Performance" (No. 3222); and "Reducing Energy Costs in Vapor-Compression Refrigeration and Air Conditioning Using Liquid Recycle—Part III: Comparison to other Energy-Saving Cycles" (No. 3223). Based on my own research and development mentioned above, the Holtzapple patent and papers overlook certain practical aspects that seriously impact the ability to apply liquid recycle to real systems, especially in centrifugal compressor-type systems.

A major problem with drawing liquid refrigerant from the condenser outlet is that the refrigerant tends to flash or vaporize. In low pressure systems, when the condensed refrigerant exits the condenser, the pressure tends to decrease proportionately more quickly than its temperature. This pressure decrease can be substantial in a centrifugal compressor-type refrigeration system having a high-low float valve, rather than an expansion orifice, to meter refrigerant into the evaporator. Whenever the pressure in a liquid drops below the vapor pressure corresponding to its temperature, the liquid will vaporize. When this happens within an operating centrifugal pump, such as used for liquid pressure amplification, the vapor bubbles are carried along to a point of higher pressure where they suddenly collapse. This phenomenon is known as cavitation. Cavitation is a serious problem because it results in metal removal, vibration, reduced flow, loss in efficiency, and noise. In addition, cavitation may occur in the pump inlet which can damage the impeller vanes near the inlet edges.

When employing centrifugal liquid pumps, certain precautions must be taken to avoid cavitation and the problems it causes. At the centrifugal pump inlet, it is necessary to maintain a required net positive suction head $(NPSH)_R$ which is the equivalent total head of liquid at the pump centerline less the vapor pressure of the refrigerant. To avoid cavitation, the available net positive suction head $(NPSH)_A$ must be equal to or greater than the $(NPSH)_R$. The $(NPSH)_A$ depends on the total head, the pump speed, the capacity, and impeller design.

More importantly, in trying to pump liquid refrigerant the $(NPSH)_A$ depends on the characteristics of the refrigerant, such as its vapor pressure and its temperature and pressure when it enters the inlet of the centrifugal pump. For example, refrigerant R-11 will flash readily. Moreover, centrifugal compressor systems, which most commonly use R-11, typically operate in a pressure range in which flashing can easily occur. Such a system typically has an evaporator pressure of about half an atmosphere and a condenser pressure of one to two atmospheres. Also, these pressures can fluctuate substantially as the float valve opens and closes to meter liquid refrigerant into the evaporator, causing refrigerant to be drawn away from the liquid pump inlet and reducing NPSH.

This fluctuation is not a problem in the system described in my prior U.S. Pat. No. 5,180,580. All of the refrigerant discharged from the condenser is input to the centrifugal liquid pump's intake, and so the intake pressure is maintained at a consistently high level. Also, the use of a positive displacement-type compressor will ordinarily maintain a higher pressure at the centrifugal liquid pump's intake. This arrangement would be impractical in a centrifugal compressor-type system, however, because adding an increment of pressure to entire liquid flow from the condenser would increase the pressure of the liquid refrigerant against a closed float valve sufficiently to overfeed the liquid recycle branch to the condenser. As discussed by Holtzapple, this is undesirable.

Moreover, in recent years there has been a growing concern that chlorofluorocarbon (CFC) refrigerants, such as R-11, tend to damage the earth's ozone layer. As a result, state and federal legislation are being enacted which significantly regulates the use of such refrigerants. Thus, more and more, manufacturers of refrigerant systems are developing alternatives to CFC refrigerants. The suggested alternatives, such as blends of non-CFC refrigerants, although more environmentally sound, have lower vapor pressures and therefore flash more easily. Accordingly, conventional refrigeration systems which use the new environmentally desirable refrigerants are even more susceptible to flashing and therefore limit the use of conventional centrifugal compressor-type systems even further.

Holtzapple's approach is to employ a conventional hydraulic pump to recycle a portion of the liquid refrigerant to the condenser inlet. Common hydraulic pumps, such as rotary vane pumps and gear pumps, are positive displacement pumps that do not require a net positive suction head to operate. Thus, low vapor-pressure refrigerants, which easily flash and cause cavitation in centrifugal pumps, can be readily pumped by such hydraulic pumps. Hydraulic pumps have several drawbacks, however, when employed in refrigeration systems. They have metal to metal contact which makes them very susceptible to wear. Thus, they must be continuously lubricated to be operational. Preferably, hydraulic pumps are lubricated by the fluid they are pumping, such as oil or water. Refrigerants such as R-11 are, however, actually solvents that provide little or no lubricating effect. This factor also makes it impractical to use oil-type lubricant, as they will be dissolved and contaminate the refrigerant. As a result, conventional hydraulic pumps, used continuously in refrigerant systems, would rapidly wear, require constant maintenance, and prematurely fail. Thus, in Holtzapple's system, any efficiencies gained by desuperheating using recycled refrigerant would be offset by the inefficiencies associated with using a hydraulic pump.

Centrifugal pumps, on the other hand, do not need lubrication and are now the standard pump used in refrigeration systems. Further advantages of centrifugal pumps are their simplicity, low first cost, uniform (nonpulsating) flow, small floor space, low maintenance expense, quiet operation, and adaptability for use with a motor. Thus, it is preferable to utilize centrifugal pumps whenever design parameters permit. In centrifugal compressor-type systems, however, this has proven to be unsatisfactory because of the NPSH-cavitation problems. Also, it is not practical to utilize floating head pressures in such a system, as in a positive displacement-type system, because of the need to use anti-surge controls in centrifugal compressor-type systems.

Accordingly, a need remains for a refrigeration or air-conditioning system which combines the benefit of desuperheating using liquid refrigerant recycle with the practicalities and efficiencies of centrifugal liquid pumping means.

SUMMARY OF THE INVENTION

One object of the invention is to facilitate the use of a centrifugal pump in a refrigerant branch line from a conduit between the condenser and evaporator to feed a portion of the condensed liquid refrigerant back to the compressor outlet and condenser inlet to desuperheat the compressed refrigerant.

Another object of the invention, as aforesaid, is to enable a centrifugal pump to be used in a centrifugal compressor-type system for liquid refrigerant injection into superheated refrigerant gases output from the centrifugal compressor.

This invention is a refrigeration or air conditioning system, capable of operating at low pressures, which comprises a compressor, a condenser and an evaporator interconnected in series in a closed loop for circulating refrigerant therethrough, utilizing an improved way of recycling liquid refrigerant to desuperheat compressed refrigerant vapors. The system includes a first conduit coupling an outlet of the compressor to an inlet to the condenser to convey superheated refrigerant vapor from the compressor into the condenser at a first pressure and first temperature and a second conduit coupling the outlet of the condenser to an inlet to the evaporator to transmit a first portion of the condensed liquid refrigerant from the outlet of the condenser into the evaporator at a second pressure less than the first pressure to vaporize and effect cooling for air conditioning or refrigeration. A subcooler having an inlet coupled to the second conduit receives a second portion of the condensed liquid refrigerant from the outlet of the condenser, at a second temperature less than the first temperature, and lowers the temperature of the second portion of condensed liquid refrigerant by an increment of temperature within a predetermined range to discharge the second portion of condensed liquid refrigerant from an outlet of the subcooler at a third temperature lower than the second temperature. A centrifugal pump having an inlet coupled to the outlet of the subcooler receives the subcooled second portion of condensed liquid refrigerant and boosts its pressure by an increment of pressure within a predetermined range to discharge the second portion of condensed liquid refrigerant at a third pressure higher than the first pressure. A third conduit is coupled to the outlet of the centrifugal pump to an inlet to the condenser to transmit the second portion of the condensed liquid refrigerant, now subcooled and pressurized to said third temperature and third pressure, from the outlet of the centrifugal pump into the first conduit to vaporize therein and effect cooling of the superheated vapor refrigerant entering the condenser to a reduced temperature, thereby reducing the first pressure.

Another aspect of this invention is a method for improving the operation of a refrigeration or air-conditioning system which includes a compressor, a condenser, and an evaporator connected in series by conduit for circulating refrigerant in a closed loop therethrough. The method comprises transmitting superheated vapor refrigerant from the compressor to an inlet of the condenser at a first temperature and first pressure; condensing the vapor refrigerant to discharge liquid refrigerant at a second temperature less than the first temperature; transmitting a first portion of the liquid refrigerant at the second temperature into the evaporator at a second pressure less than the first pressure to effect cooling; subcooling a second portion of the liquid refrigerant to a third temperature less than the second temperature by a predetermined increment of temperature; boosting the second pressure of the subcooled second portion of the liquid refrigerant to a third pressure greater than the first pressure by a substantially constant increment of pressure; and transmitting the second portion of liquid refrigerant at the third pressure and temperature into the condenser inlet so that the first temperature of the superheated vapor refrigerant is reduced toward the second temperature, thereby reducing the first pressure.

Preferably, the compressor is a centrifugal compressor and the system includes a float valve between the condenser and the evaporator. The proportion of liquid refrigerant that is recycled via the subcooler and centrifugal pump can vary but is generally in the range of 10–30% and typically about 20% of the total flow discharged from the condenser. The subcooler is preferably positioned in a branch line from the second conduit which feeds liquid refrigerant to the centrifugal pump, and can be formed by a heat exchanger coupled to the evaporator, for example, by a chilled water circuit.

In defining the first, second and third pressures and temperatures, it should understood that these pressures and temperatures can vary depending on where they are measured in a real system, because of heat and pressure losses in refrigerant flowing over extended distances. Persons skilled in the art will readily understand that such losses may be taken into account in the detailed engineering of each system, while remaining consistent with the spirit of the principles of the invention.

The foregoing and other objects, features and advantages of the invention will become more readily apparent from the following detailed description of a preferred embodiment of the invention which proceeds with reference to the accompanying drawings.

DETAILED DESCRIPTION

To understand how we can improve the refrigeration cycle we must first analyze the components of a conventional air-conditioning system and understand where the inefficiencies exist.

Figure 1:
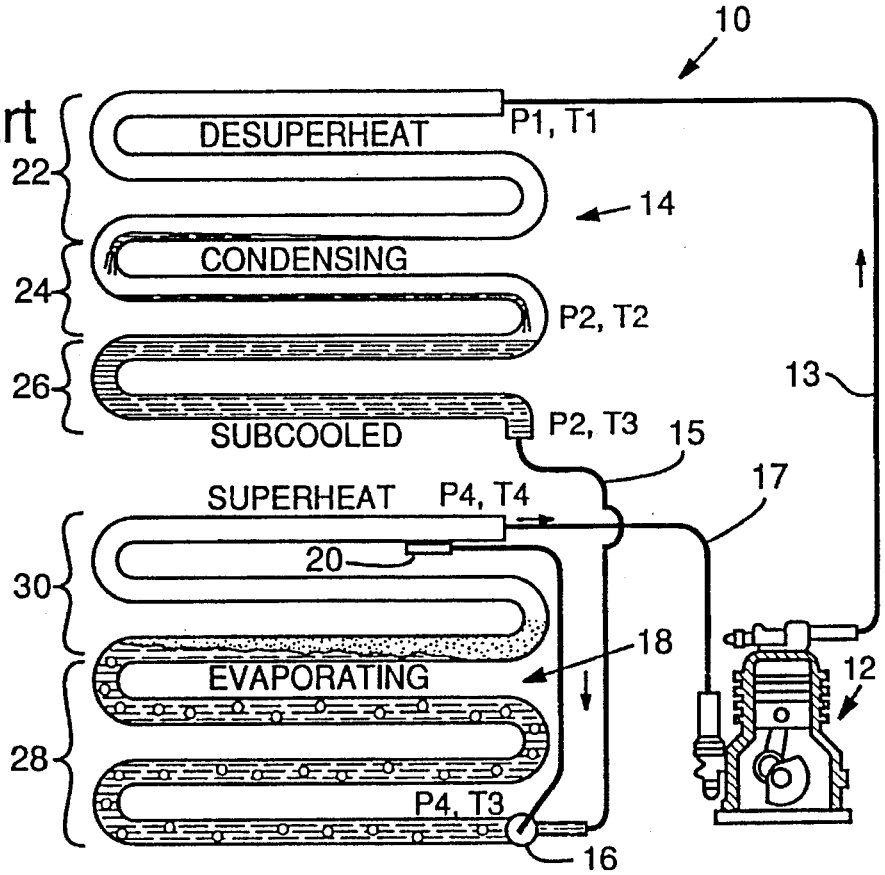
FIG. 1 Prior Art
FIG. 1 is a schematic diagram of a conventional air-conditioning system, with the condenser and evaporator shown in cross section and shaded to indicate regions occupied by liquid refrigerant during condensation and evaporation.

FIG. 1 depicts the conventional air-conditioning circuit 10. The circuit of FIG. 1 consists of the following elements: a compressor 12, condenser 14, expansion valve 16, and evaporator 18 with temperature sensor 20 coupled controllably to the expansion valve, connected in series by conduits 13, 15, 17 to form a closed loop system. Shading indicates that the refrigerant within the condenser passes through three separate states as it is converted back to a liquid form: superheated vapor 22, condensing vapor 24 and subcooled liquid 26. Similarly, shading in the evaporator indicates that the refrigerant contained therein is in two states: vaporizing refrigerant 28 and superheated vapor 30. Pressures and temperatures are indicated at various points in the refrigeration cycle by the variables P1, T1, P2, T2, etc.

In the evaporator, only the refrigerant changing from a liquid state 28 (P4, T3) to a vapor state 30 (P4, T4, assuming $\Delta P$ small) provides refrigerating effect. The more liquid refrigerant (state 28)in the evaporator, the higher its cooling capacity and efficiency. The ratio of liquid to vapor refrigerant can vary. The determining factors are the performance of the expansion valve, the proportion of "flash gas" entering the evaporator through the valve, and the temperature T3 and pressure P4 of the entering liquid refrigerant. As can be seen in FIG. 1, only superheated vapor (state 30) enters the compressor 12. The term "superheat" refers to the amount of heat in excess of the latent heat of the vaporized refrigerant, that is, heat which increases its volume and/or pressure. High superheat at the compressor inlet can add considerably to the work that must be performed by other components in the system. Ideally, the vapor entering the compressor would be at saturation, containing no superheat and no liquid refrigerant. In most systems using a reciprocating compressor 12 this is not practical. We can, however, make significant improvements.

The discharge heat of the vapor exiting from the compressor includes the superheat of the vapor entering the compressor plus the heat of compression, friction and the motor added by the compressor. At the entrance of the condenser, all of the refrigerant consists of superheated vapors at pressure P1 and temperature T1. The portion of the condenser needed to desuperheat the refrigerant (state 22) is directly related to the temperature T1 of the entering superheat vapors. Only after the superheat is removed can the vapors start to condense (state 24).

The superheated vapors 22 are subject to the Gas Laws of Boyle and Charles. At a higher temperature T1, they will tend to either expand (consuming more condenser area) or increase the pressures P1 and P2 in the condenser, or a combination of both. The rejection of heat at this point is vapor-to-vapor, the least effective means of heat transfer.

As the vapors enter the condensing portion of the condenser they are at saturation (state 24) and at a pressure P2 and temperature T2 which are less than P1 and T1, respectively. At this stage, further removal of latent heat will convert the vapors into the liquid state 26. The pressure P2 will not further change during this stage of the process.

As the refrigerant starts to condense, the condensation will take place along the walls of the condenser. At this point, heat transfer is from liquid-to-vapor, and produces a more efficient rejection of unwanted heat.

The condensing pressures are influenced by the condensing area (total condenser area minus the area used for desuperheating and the area used for subcooling). The effect of superheat can be observed as both a reduction in condensing area (state 24) and an increase in the overall pressure (both P1 and P2).

In an effort to suppress the formation of flash gas entering the expansion valve, many manufacturers use part of the condenser to further cool or subcool the liquid refrigerant to a lower temperature T3 (state 26). If we consider only the subcooling of the liquid without regard to decreased condensing surface, then we can expect a gain of ½% refrigeration capacity per degree (F.) of subcooling. If we consider the reduction in condensing surface, however, then there is a net loss of capacity and efficiency due to increased condensing temperature T2 and higher head pressure P1.

Analysis of the refrigeration cycle shows that several factors that can be improved. Combining these factors, as described with reference to FIG. 4, can dramatically improve the overall capacity and efficiency of performance.

Figure 2:
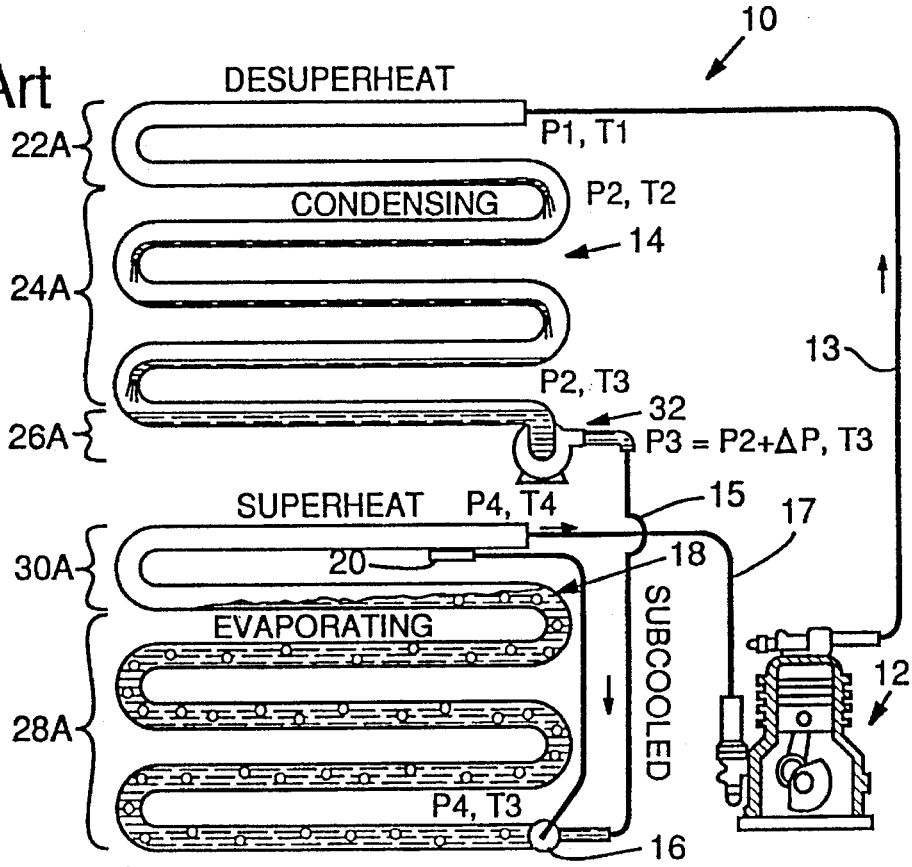
FIG. 2 Prior Art
FIG. 2 is a view similar to FIG. 1 showing the system as modified to include a liquid pump in accordance with the teachings of my prior patent.

FIG. 2 illustrates, in an air-conditioning system, the effects of liquid pumping as taught in my prior U.S. Pat. No. 4,599,873, incorporated herein by reference. The system is largely the same as that of FIG. 1, so like reference numerals are used on like parts. The various states are indicated by like reference numerals followed by the letter "A." Temperatures and pressures are also indicated in like manner with the understanding that the quantities symbolized by the variables differ substantially in each system.

The principal structural difference is that a liquid refrigerant centrifugal pump 32 is installed between the outlet of the condenser 14 (on systems that do not have a receiver) and the expansion valve 16. The pump 32 increases the pressure P2 of the liquid refrigerant flowing from the condenser outlet by a ΔP of 8 to 15 p.s.i. to an incrementally increased pressure P3. This is referred to as the liquid pressure amplification process. The pressure added to the liquid refrigerant will transfer the refrigerant to the subcooled region of the enthalpy (i.e., P3>P2, T3 same), and will not allow the refrigerant to flash prematurely, regardless of head pressure. By eliminating the need to maintain the standard head pressure, minimum head pressure P1 can be lowered to 30 p.s.i. above evaporator pressure P4 in air-conditioning and refrigeration systems. Condensing temperature T1 can float rather than being set to a fixed minimum temperature in a conventional system, e.g., 105° F. in R-22 air-conditioning systems. If ambient temperature is 65° F., using a pump 32 in an R-22 air-conditioning system lowers condensing temperature T1 to about 86° F. at full load. Additionally, head pressure P1 is lowered, as next explained.

For the evaporator 18 to operate at peak efficiency it must operate with as high a liquid-to-vapor ratio as possible. To accomplish this, the expansion valve 16 must allow refrigerant to enter the evaporator at the same rate that it evaporates. Overfeeding or underfeeding of the expansion valve will dramatically affect the efficiency of the evaporator. Using pump 32 assures an adequate feed of liquid refrigerant to valve 16 so that the exhaust refrigerant at the intake of compressor 12 is at a temperature T4 and pressure P4 closer to saturation.

Figure 3:
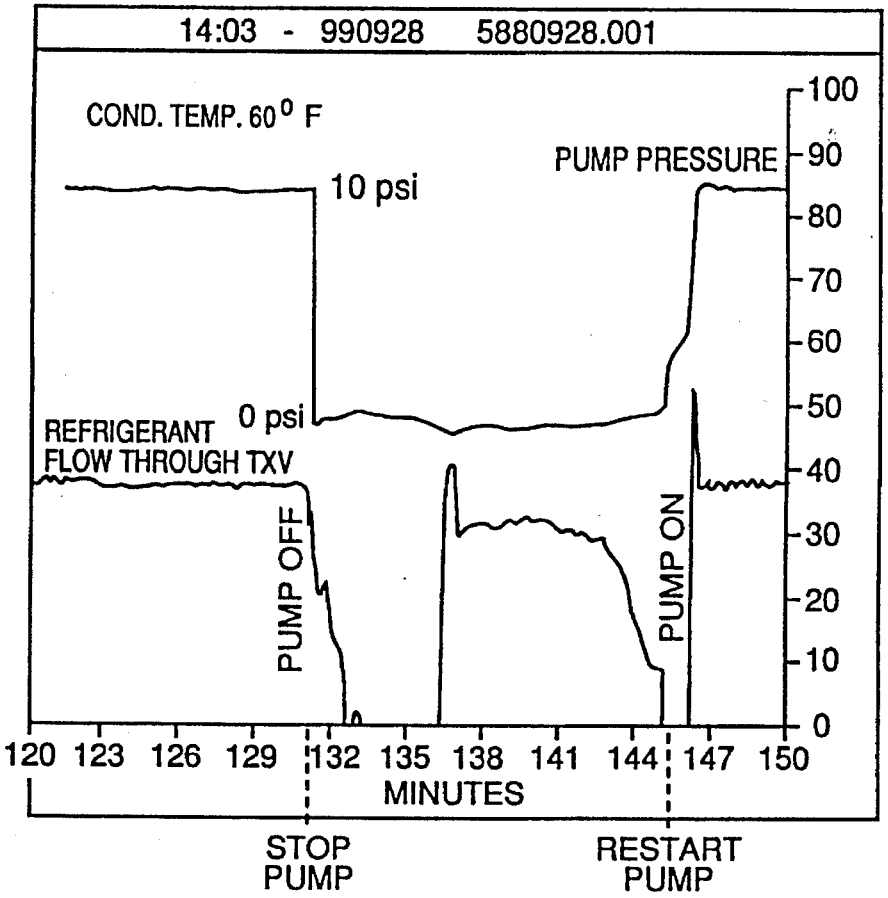
FIG. 3 is a graph of certain parameters of operation of the system of FIG. 2 with the liquid pump ON and OFF.

FIG. 3 graphs the flow rate of refrigerant through the expansion valve 16 in laboratory tests with and without the liquid pump 32 running. The upper trace indicates incremental pressure added by pump 32 and the lower trace graphs the flow rate of refrigerant through the expansion valve. The test begins with the system running in steady state with centrifugal pump 32 ON. At 131 min. the pump was turned OFF. The flow rate of refrigerant entering the evaporator 18 through the expansion valve 16 (TXV) shows a decided decrease in flow compared to the flow when the pump is running. An increase in head pressure only partially restores refrigerant flows. The reduced flow of refrigerant to the evaporator has several detrimental effects, as shown in FIG. 1. Note the reduced effective evaporator area 28 as compared to area 28A in FIG. 2.

At 150 min., the liquid pump 32 is turned ON. With the pump 32 again running, the flow rate is consistently higher, with an even modulation of the expansion valve, because of the absence of flash gas. It can be seen that running the pump increases the amount of refrigerant in the evaporator yet the superheat setting of the valve controls the modulation of the expansion valve at a consistent flow rate. The net result is a greater utilization of the evaporator 18 as shown in FIG. 2 (note state 28A).

The efficiency of the compressor 12 is related to a number of factors, most of which can be improved when the liquid pumping system is applied. The efficiencies can be improved by reducing the temperature in the cylinders of the compressor, by increasing the pressure P4 of the entering vapor, and by reducing the pressure P1 of the exiting vapor. With the vapor entering the compressor at a higher pressure, the compressor capacity will increase. With cooler gas (T4) entering the cylinders, the heat retained in the compressor walls will be less, thereby reducing the expansion, due to heat absorption, of the entering vapor.

With these improvements on the suction side of the compressor, the condensing temperature T1 can float with the ambient to a lower condensing temperature in the system of FIG. 2. This reduces the lift, or work, of the compressor by reducing the difference between P4 and P1. The increased capacity or power reduction, due to the lower condensing temperatures, will be approximately 1.3% for each degree (F.) that the condensing temperature is lowered. As explained earlier, the liquid pump's added pressure ΔP maintains all liquid leaving the pump 32 in the subcooled region of the enthalpy diagram. For this reason, it is no longer necessary to flood the bottom part of the condenser (See 26 in FIG. 1) to subcool the refrigerant. This portion of the condenser can now be used to condense vapor (Compare state 24A of FIG. 2 with state 24 in FIG. 1). This increased condensing surface can further lower the condensing temperature T2 and pressure P2. The temperature T3 of the refrigerant leaving the condenser will be approximately the same as if subcooled, but with little or no subcooling (state 26A).

With the application of the pump 32, the evaporator discharge or superheat temperature T4 and compressor intake pressure P4 have been reduced considerably from corresponding parameters in the system of FIG. 1.

The best results are obtained when such a system is operated with the condenser at moderate ambient temperatures, usually under 80° F. As ambient temperatures rise above the minimum condensing temperature, the advantages gradually decrease. At a typical ambient temperature of around 75° F., a typical improvement in efficiency of the system of FIG. 2 over that of FIG. 1 is 7%–10%, declining to negligible at 100° F. ambient temperature.

I have discovered, however, that an additional 6% to 8% savings can be achieved under typical ambient conditions. Moreover, we can obtain very substantial improvements of efficiency and effectiveness at ambient temperatures over 100° F.

Figure 4:
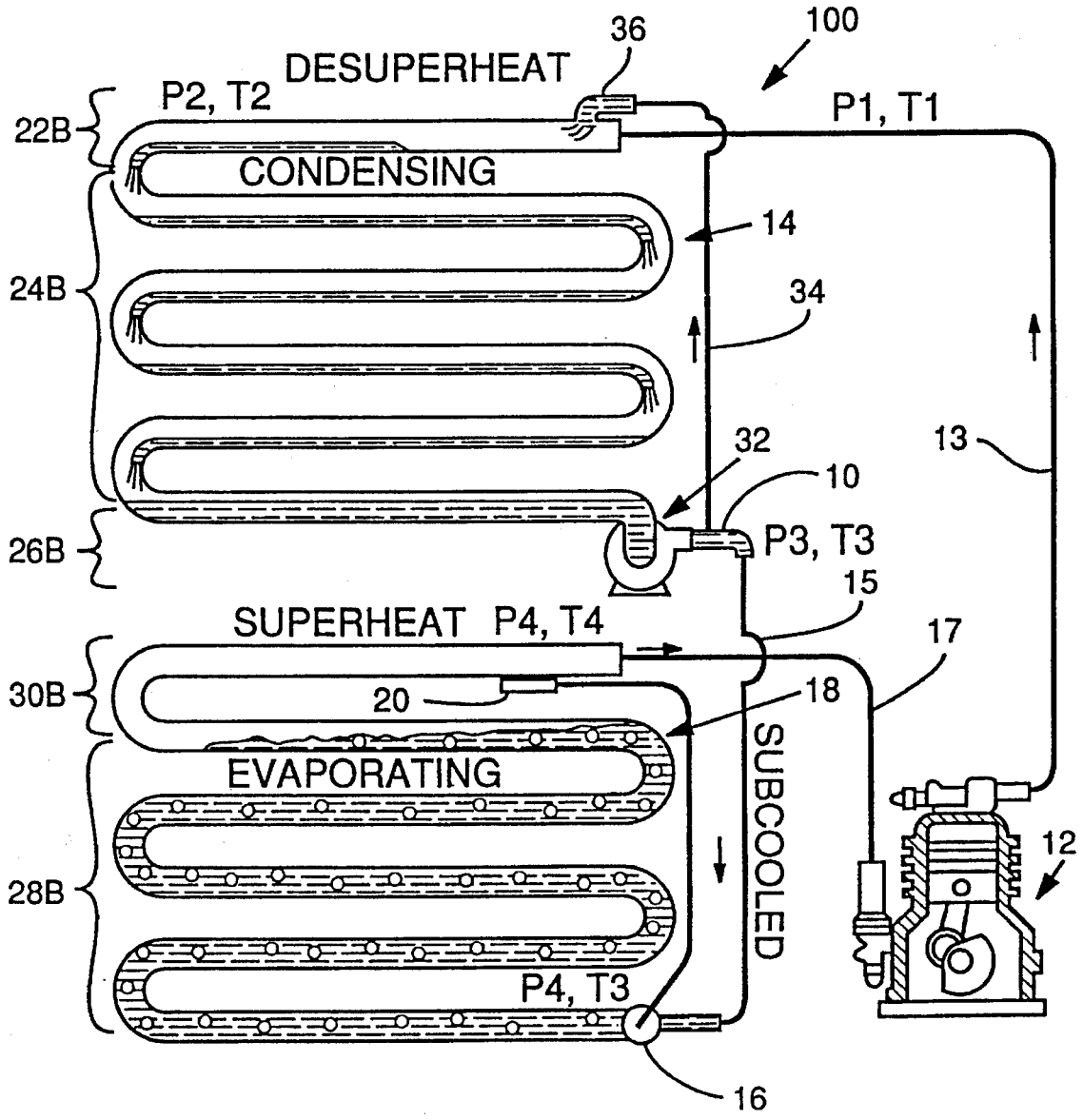
FIG. 4 is a view similar to that of FIG. 2 showing the system as further modified for superheat suppression.

FIG. 4 shows an air-conditioning system 100 as taught in my U.S. Pat. No. 5,150,580. The general configuration of the system resembles that of system 10A in FIG. 2. In accordance with the invention, however, a conduit or line 34 is connected at one end to the outlet of pump 32 and at the opposite end to an injection coupling 36 at the entrance to the condenser. This circuitry enables a portion of the condensed liquid refrigerant to be injected at temperature T3 from the pump outlet into the entrance of condenser. As this liquid refrigerant enters the desuperheating portion of the condenser, it will immediately reduce the temperature of, and thereby suppress, the superheated vapors entering the condenser at pressure P1 and temperature T1.

The amount of refrigerant injected at coupling 36 should be sufficient to dissipate the superheated vapors and preferably reduce the incoming temperature T1 to a temperature close (within 10° F.–15° F.) to the saturation temperature T2 of the refrigerant. In a 10 ton, 120,000 BTU air-conditioning system, line 15 has an inside diameter of ½ inch and line 34 has an inside diameter of ⅛ inch, for a cross-sectional ratio of line 34 to line 15 of 1:16 or about 6%. Due to flow rate differences and variations (e.g., due to modulation of valve 16 by sensor 20) the flow ratio is less than about 5%, probably 2%–3%, in a typical application.

Suppression of superheated vapor will have four effects:

(1) By reducing the superheat temperature T1, the pressure P1 and volume of the superheat vapors will both be reduced.

(2) The vapor will be very close to or at saturation point (T2, P2).

(3) Condensing will occur closer to the inlet of the condenser.

(4) Heat transfer will be higher because of liquid-to-vapor heat transfer over a greater area of the condenser (compare state 24B with state 24A).

The injection of liquid refrigerant into the condenser 14 is accomplished using the same pump 32 that is installed for the liquid pressure amplification process. By reducing the work required to desuperheat the refrigerant vapor, the pump can perform a substantial portion of the work required to recirculate the liquid through the condenser. Although some gain can be seen at low ambient temperature, with this process of superheat suppression, the best gains will be realized at higher ambient temperature. This is just the opposite of the benefits noted with liquid refrigerant amplification alone. For example, at over 100° F., the system of FIG. 2 gives little if any increase in efficiency and capacity over the system of FIG. 1. Tests have shown that the system of FIG. 4, on the other hand, will provide efficiency increases of 10%–12% at 100° F. and as much as 20% at 113° F., and add capacity to allow air conditioning to be run effectively in the desert.

Figure 5:
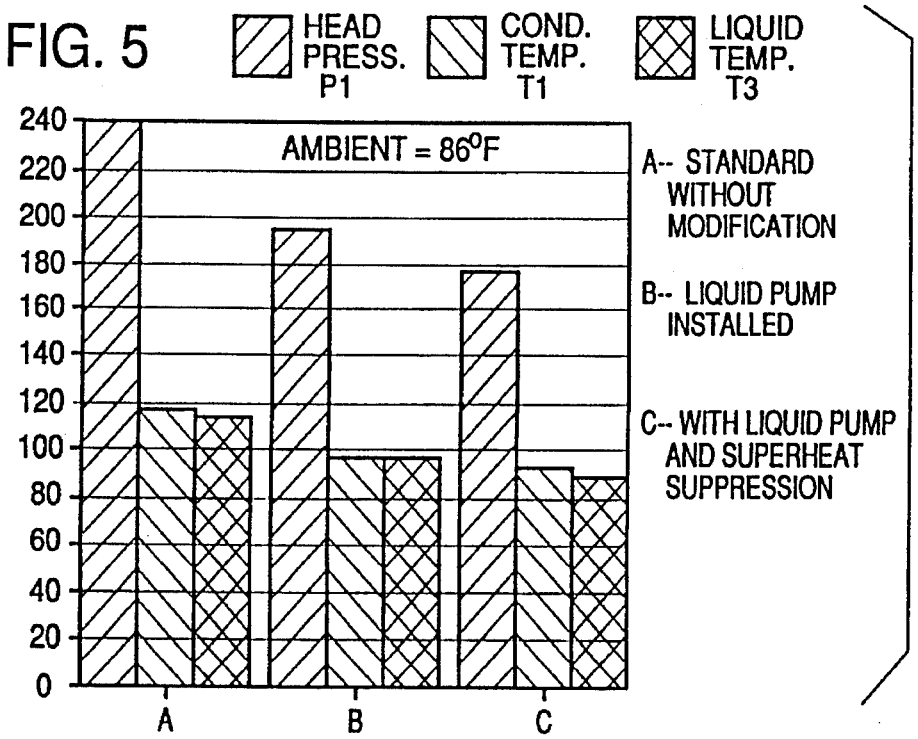
FIG. 5 is a chart of test results comparing three parameters for each of the systems of FIGS. 1,2 and 4 operating under like ambient conditions.

FIG. 5 is a graph of actual results achieved in a test of a 60 ton Trane air-conditioning system comparing operation of system 100 of FIG. 4 with operation of systems 10 and 10A of respective FIGS. 1 and 2. All readings were taken at 86° F. ambient temperature. The readings are: A. standard system without modification (FIG. 1), B. same system adding the pump 32 only (FIG. 2), and C. the same system modified in accordance with the present invention to include both pump 32 and superheat suppression circuitry 34, 36 (FIG. 4). For each parameter—head pressure P1 (p.s.i.), condensing temperature T1 (° F.) and liquid temperature T3 (° F.) entering the evaporator—configuration C, the present invention, demonstrated lower readings. Such performance characteristics enable a system 100 according to the present invention to provide a greater cooling capacity as well as greater efficiency. These advantages continue to higher ambient temperatures, including temperatures at which configurations A and B would no longer be effective.

I have discovered, however, that by using the present invention, further described below, 4% to 15% savings can be achieved in a centrifugal compressor-type system under typical ambient conditions. This savings is accomplished by subcooling a portion of the condensed liquid discharge from the condenser and using a centrifugal pump to recycle the subcooled refrigerant back into the condenser intake at an increased pressure over the discharge pressure from the condenser. This improvement allows us to operate with much larger systems, at lower pressures characteristic of centrifugal compressor-type systems, and with more environmentally desirable refrigerants.

Figure 6:
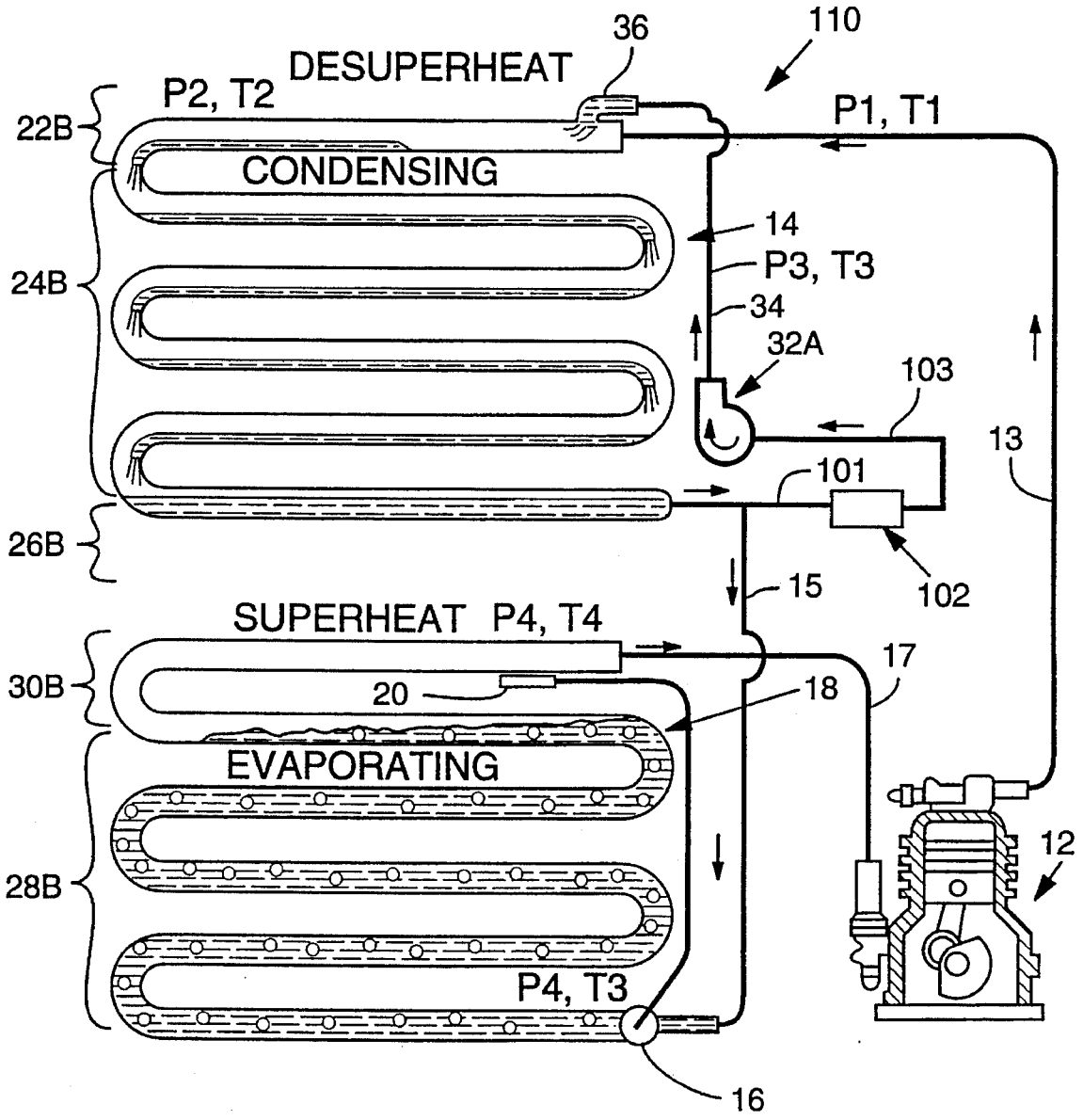
FIG. 6 is a view similar to that of FIG. 4 showing the system as further modified for superheat suppression in accordance with the present invention.

FIG. 6 shows an air conditioning or refrigeration system 110 in accordance with the present invention. The general configuration of the system is similar to that of system 100 shown in FIG. 4, but has the centrifugal pump positioned in a branch line 101 off the conduit 15. In accordance with the present invention, a portion of the condensed liquid refrigerant is recycled via conduit 101 to subcooler 102. The remaining liquid refrigerant is transmitted via conduit 15 to the expansion valve 16.

Liquid refrigerant enters the subcooler 102 via conduit 101 and exits it via conduit 103. The cooling effect of subcooler 102 reduces the temperature T3 of the liquid refrigerant by 2° to 3° F. The purpose of subcooler is to further cool the liquid refrigerant entering the centrifugal pump intake to a temperature below its flash point. With flashing eliminated, the $(NPSH)_A$ will be greater than the $(NPSH)_R$ for centrifugal pump 32A and therefore greatly reduce the likelihood of cavitation.

The subcooled liquid refrigerant is transmitted via conduit 103 to centrifugal pump 32A. Centrifugal pump 32A boosts the pressure of the recycled refrigerant by an increment in the range of 5 to 30 p.s.i. Conduit 34 carries the recycled refrigerant to injector 36 and desuperheating is accomplished as described above.

Figure 7:
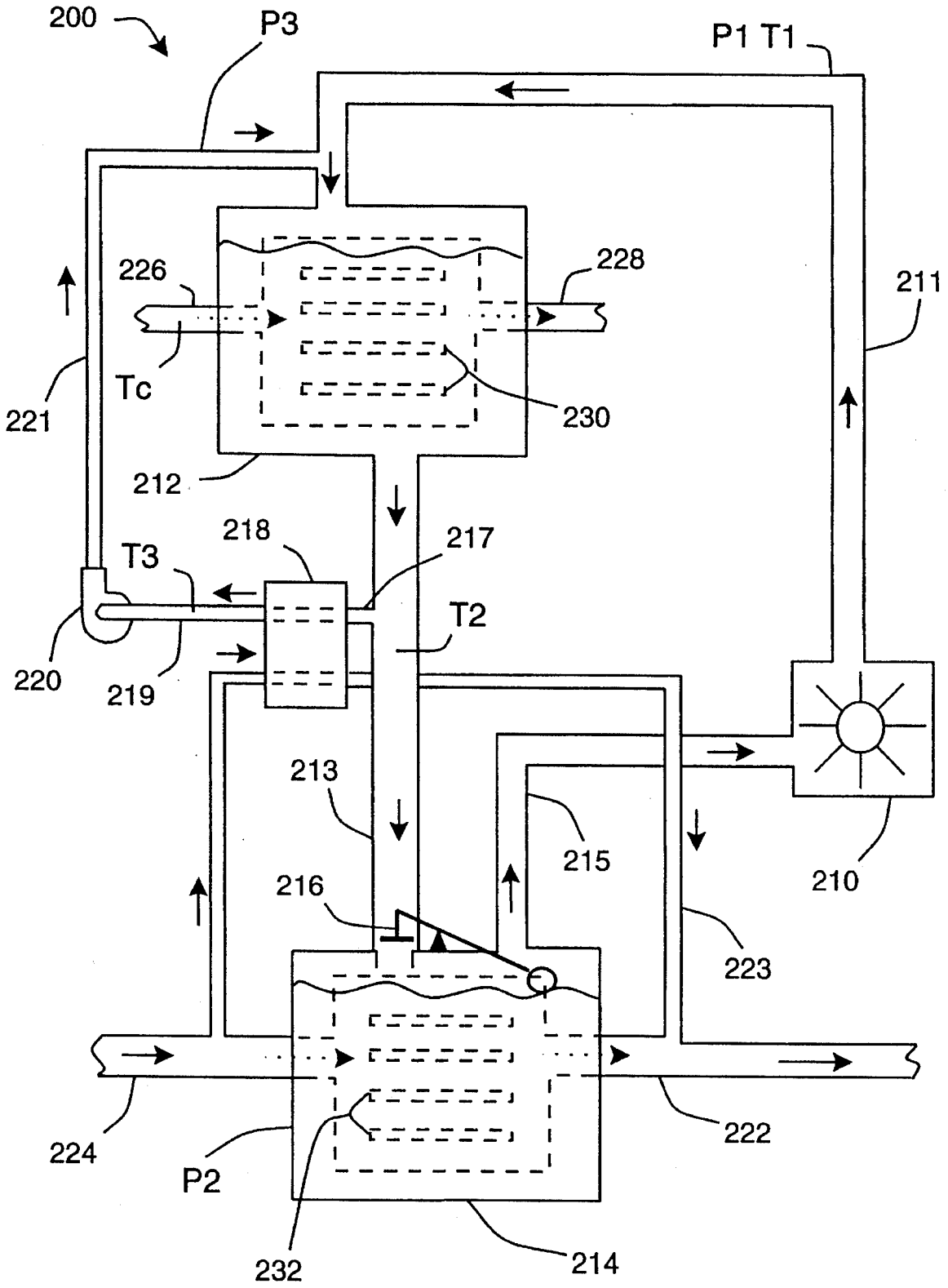
FIG. 7 is a schematic diagram of a second embodiment of the present invention, implemented in a refrigeration or air-conditioning system employing a centrifugal compressor, with water circulation heat-exchangers in the condenser, evaporator and subcooler shown in the dashed lines.

FIG. 7 illustrates an alternative preferred embodiment, implemented in a centrifugal compressor-type refrigeration system 200, in accordance with the present invention. It comprises a centrifugal compressor 210 with conventional head pressure and surge controls, a water-cooled condenser 212, water-chiller evaporator 214 with a high-low float valve 216, connected in series by a first conduit 211 from compressor outlet to condenser inlet, a second conduit 213 from the condenser outlet to the evaporator inlet, and a conduit 215 from the evaporator outlet to the compressor inlet. The system also comprises a recycle circuit including a subcooler 218 and a centrifugal pump 220 connected in series between conduit 213 and conduit 211 by a series of conduits 217, 219, 221 forming a third or recycle conduit.

This circuitry enables a portion of the condensed liquid refrigerant to be injected at temperature T3 from the pump outlet into the entrance of the condenser. Compressed, superheated vapor which is generated by compressor 210 flows along conduit 211 where it mixes with the recycle stream from conduit 221 before entering condenser 212. As the liquid refrigerant enters the condenser, it will immediately desuperheat the compressed refrigerant vapors entering the condenser at pressure P1 and temperature T1, thereby reducing both their pressure and temperature. A lesser portion of the liquid refrigerant discharged from the condenser is recycled to the subcooler 218 via conduit 217, with the remainder flowing to the evaporator 214. Preferably, 10% to 30% of the liquid refrigerant is recycled from the condenser outlet through the subcooler and centrifugal pump to the condenser. Most preferably, about 20% or less of the liquid refrigerant is recycled.

Condenser 212 is preferably a shell and tube type heat exchanger with the refrigerant on the shell side and cooling water on the tube side. Cooling water enters condenser 212 via condenser cooling water intake 226 and exits the condenser via condenser cooling water discharge 228. As the vapors enter condenser 212, they are ideally at saturation (they would not be if superheated). As the vapors progress through the condenser they contact the condenser heat exchanger tubes shown in dashed line, which remove the latent heat, thereby converting the vapors into liquid. The excess heat is carried outside the system by the flow of cooling water. The condensed vapors, now liquid, accumulate at the bottom of the condenser and flow downwardly through conduit 213 to evaporator 214.

Subcooler 218 is preferably a counterflow heat exchanger. Recycled liquid refrigerant enters the subcooler via conduit 217 and exits the subcooler via conduit 219. Cooling water is transmitted from evaporator heating water intake 224 via conduit 225 to the subcooler and then returned to the evaporator heating water discharge 222 via conduit 223. Because of the cooling effect of subcooler 218, temperature T3 preferably ranges from 2° to 3° F. below the condenser outlet temperature. It is also possible to expand the condenser to effect subcooling before pumping but this is very expensive in typical large centrifugal compressor-type systems, and is less efficient because it requires subcooling the entire flow of refrigerant between the condenser and evaporator. Thus, it is much preferred, both for ease of retrofitting and for economy of operation, to use a separate subcooler in the branch line 217, 219 leading to the intake of pump 220.

The subcooled liquid refrigerant is transmitted via conduit 219 to the intake of centrifugal pump 220. Since the centrifugal pump 220 is used only in branch line 217, 219, 221, not in the main conduit 213 between condenser and evaporator, it can be much smaller in proportion to overall system capacity than the pump 32 used in the system 100 of FIG. 4. Centrifugal pump 220 can range from about 1/25 H.P. to ¾ H.P. and can produce approximately 5–30 p.s.i. increase in pressure, depending on system size and operating conditions. The centrifugal pump 220 is preferably a sealless pump, more preferably a magnetic drive pump, wherein the pump impeller is semihermetically sealed (either alone or with the drive motor) and driven via a connection to the motor that does not require a sealed shaft.

The much larger portion of condensed liquid refrigerant, which is not recycled to the subcooler 218, continues on to evaporator 21 4 via conduit 213. The evaporator is preferably a shell and tube heat exchanger with the refrigerant liquid on the shell side and heating water on the tube side. Coolant water enters the evaporator via evaporator water intake 224 and exits the evaporator via evaporator chilled water discharge 222. As the liquid refrigerant flows into the evaporator and vaporizes, it buoys a high-low float valve 216. Float valve 216 controls the flow of liquid refrigerant into the evaporator depending on the level of liquid refrigerant in the evaporator. Thus, when the liquid level of refrigerant in the evaporator is high, float valve 216 is closed and no liquid refrigerant flows into the evaporator. As the liquid evaporates, the liquid level drops and the float valve opens allowing the flow of liquid into the evaporator.

When the liquid refrigerant enters the evaporator, it contacts tubes, shown in dashed lines, carrying the coolant water. The liquid refrigerant vaporizes at temperature T2 and pressure P2, taking with it the heat of vaporization which creates the refrigeration effect. The refrigerant vapors exit the evaporator and are transmitted via conduit 223 to the centrifugal compressor 210. In the compressor, the refrigerant vapors are recompressed to produce superheated compressed vapor having a pressure P1 and a temperature T1. The superheated vapors are transmitted via conduit 211 to condenser 212, to be desuperheated by the liquid refrigerant from conduit 221 and recondensed.

EXAMPLE

Pressures and temperatures are indicated for system 200 at various points in the refrigeration cycle by the variables P1, T1, P2, T2, etc. Typical values for these and other system variables are given for a 1500 ton R-II system retrofitted and tested in the configuration shown in FIG. 7, using a 3 inch ID liquid conduit 213, ¾" pipe for conduits 217, 219 and 221, and a ½ hp centrifugal pump 220 rated at 60 gpm and typically running at 20–60 gpm. Controls on the pump drive give a minute or two delayed startup. In typical operation, T1 is about 130° F. and P1 is 4–8 psig (1.27 to 1.54 atmospheres); T2 at the outlet of the compressor is in the range of 88°–92° F., nominally about 90° F. for a condensing water temperature TC of about 78° F.; P2 in the evaporator is a vacuum of about 17 inches of mercury (about half an atmosphere); and T3 out of the subcooler is about 2°–3° F. lower than T2, nominally about 87° F. which is sufficient to avoid flashing at the pump intake. The pressure P3 at the output of the centrifugal pump 220 varies with pressure P1 but remains above 10 psig. The temperature at the pump output is raised a degree or two by the centrifugal pumping action so the temperature of the recycled refrigerant entering the superheated gas stream is nominally about 88° F. The external shell temperature at the top of the condenser is about 120° F. when the pump 220 is off and about 87° F. when the pump is running. The water temperature into the evaporator and subcooler is typically about 52° F. ;the evaporator refrigerant temperature (saturated suction temperature) is about 35° F.; and the evaporator output water temperature is about 42° F. The foregoing are nominal temperatures and pressures which will vary depending on ambient conditions. The tested system exhibited a power reduction of 4% to 7% under summertime operating conditions in a Northern climate. Similar tests on a 500 ton system in a Southern climate preliminarily indicate somewhat higher savings.

Operating conditions can also be expected to vary for different types of refrigerants. Nonetheless, the foregoing system and method of operation are expected to provide competitive efficiencies with all present and proposed refrigerants including the binary non-CFC refrigerants that are proposed to replace common CFC-based refrigerants.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A refrigeration or air-conditioning system comprising:

a centrifugal compressor, a condenser, and an evaporator interconnected in series in a closed loop for circulating refrigerant therethrough;

first conduit coupling an outlet of the compressor to an inlet to the condenser to convey superheated vapor refrigerant from the centrifugal compressor into the condenser at a first pressure and first temperature;

a second conduit coupling the outlet of the condenser to an inlet to the evaporator to transmit a first portion of the condensed liquid refrigerant from the condenser into the evaporator at a second pressure less than the first pressure to vaporize and effect cooling for air conditioning or refrigeration;

a subcooler having an inlet coupled to the second conduit for receiving a second portion of condensed liquid refrigerant at a second temperature less than the first temperature and lowering the temperature of the second portion of condensed liquid refrigerant by an increment of temperature within a predetermined range to discharge said second portion of condensed liquid refrigerant from an outlet of the subcooler at a third temperature lower than the second temperature;

a centrifugal pump having an inlet coupled to the outlet of the subcooler for receiving the second portion of condensed liquid refrigerant as discharged from the subcooler at said third temperature and boosting the pressure of said second portion of refrigerant by an increment of pressure within a predetermined range to discharge said second portion of refrigerant at a third pressure higher than said first pressure; and a third conduit coupling the outlet of the centrifugal pump to an inlet to the condenser to transmit the second portion of the condensed liquid refrigerant from the outlet of the centrifugal pump into the inlet of the condenser to vaporize therein and effect cooling of the superheated vapor refrigerant entering the condenser to a reduced temperature, thereby reducing the first pressure.

2. A system according to claim 1 including a valve means for selectively admitting and blocking flow of the condensed liquid refrigerant from the second conduit.

3. A system according to claim 1 wherein the evaporator includes a float valve for controlling flow of the condensed liquid refrigerant from the condenser into the evaporator.

4. A system according to claim 1 wherein the first pressure ranges from one to two atmospheres and the second pressure is about one half an atmosphere.

5. A system according to claim 1 wherein centrifugal pump and third conduit are sized so that the first portion of the condensed liquid refrigerant ranges from about 10% to 30% of the total condensed liquid refrigerant discharged from the outlet of the condenser.

6. A system according to claim 1 wherein the subcooler is arranged so that the third temperature is lower than the second temperature by an increment of temperature sufficient to prevent flashing of the liquid refrigerant at an intake to the centrifugal pump.

7. A system according to claim 6 wherein the increment of temperature is 2°–3° F.

8. A system according to claim 6 wherein the subcooler is positioned in a branch from the second conduit which receives the second portion of liquid refrigerant at said second pressure and transmits the second portion via the subcooler to the centrifugal pump separately from the flow of the first portion of refrigerant transmitted to the evaporator.

9. A method for improving operation of a refrigeration or air-conditioning system which includes a centrifugal compressor, a condenser, and an evaporator connected in series by conduit for circulating refrigerant in a closed loop therethrough, the method comprising:

transmitting superheated vapor refrigerant from the compressor to an inlet of the condenser at a first temperature and first pressure;

condensing the vapor refrigerant to discharge liquid refrigerant at a second temperature less than the first temperature;

transmitting a first portion of the liquid refrigerant at said second temperature into the evaporator at a second pressure less than the first pressure to effect cooling;

subcooling a second portion of the liquid refrigerant to a third temperature less than the second temperature;

boosting the second pressure of the subcooled second portion of the liquid refrigerant to a third pressure greater than the first pressure by a substantially constant increment of pressure; and transmitting the second portion of liquid refrigerant at approximately the third pressure and temperature into the condenser inlet so that the first temperature of the superheated vapor refrigerant is reduced toward the second temperature, thereby reducing the first pressure.

10. A method according to claim 9 wherein the first pressure ranges from one to two atmospheres and the second pressure is about one half an atmosphere.

11. A method according to claim 10 wherein the third pressure exceeds the first pressure by at least 5 psi.

12. A method according to claim 10 further comprising selectively admitting and blocking flow of the condensed liquid refrigerant into the evaporator, the third temperature being lower than the second temperature by an increment of temperature sufficient to prevent flashing of the liquid refrigerant at an intake to a pump for boosting said second pressure to said third pressure.

13. A method according to claim 9 wherein the subcooler is positioned in a branch from the second conduit which receives the second portion of liquid refrigerant at said second pressure and transmits the second portion via the subcooler to a pump for boosting said second pressure to said third pressure separately from the flow of the first portion of refrigerant transmitted to the evaporator.

14. A method according to claim 13 wherein the first portion of the condensed liquid refrigerant ranges from about 10% to about 30% of the total condensed liquid refrigerant from the outlet of the condenser.

15. A method according to claim 9 wherein the third temperature is lower than the second temperature by an increment of 2° to 3° F.

16. A method according to claim 9 wherein the boosting step is performed by means of a centrifugal pump.

17. An air-conditioning or refrigeration system comprising:

a centrifugal compressor, a condenser, an evaporator, and conduit means interconnecting the compressor, condenser, and evaporator in series in a closed loop for circulating refrigerant therethrough;

a first conduit coupling an outlet of the compressor to an inlet to the condenser to convey superheated vapor refrigerant from the compressor into the condenser at a first pressure and temperature;

a second conduit coupling the outlet of the condenser to an inlet to the evaporator to transmit a first portion of the condensed liquid refrigerant from the outlet of the condenser through the expansion valve into the evaporator to vaporize and effect cooling for air conditioning or refrigeration;

a subcooler, having an inlet coupled to the second conduit receiving a second portion of condensed liquid refrigerant at a second temperature less than the first temperature and lowering the temperature of the second portion of condensed liquid portion of condensed liquid refrigerant by an increment of temperature within a predetermined range to discharge the second portion of condensed liquid refrigerant from an outlet of the subcooler at a third temperature;

a pump means having an intake coupled to the outlet of the subcooler for receiving the second portion of condensed liquid refrigerant, the third temperature being sufficiently lower than the second temperature to prevent flashing of the refrigerant at the pump means intake, the pump means being operative to boost the pressure of the second portion of the condensed liquid refrigerant by a substantially constant increment of pressure within a predetermined range to discharge the second portion of condensed liquid refrigerant at a third pressure higher than the first pressure; and a third conduit coupling an outlet of the pump means to an inlet to the condenser to transmit the second portion of the condensed liquid refrigerant into the condenser to vaporize therein and effect cooling of the superheated vapor refrigerant entering the condenser to a reduced temperature, thereby reducing the vapor refrigerant to a saturated condition.

18. A method for improving operation of a refrigeration or air-conditioning system which includes a centrifugal compressor, a condenser, an expansion valve, and an evaporator connected in series by conduit for circulating refrigerant in a closed loop therethrough, the method comprising:

transmitting superheated vapor refrigerant from the compressor to an inlet to the condenser at a first temperature and pressure;

condensing the vapor refrigerant to discharge liquid refrigerant at a second temperature and pressure less than the first temperature and pressure;

transmitting a first portion of the liquid refrigerant at the second temperature through the expansion valve into the evaporator to vaporize and effect cooling for air conditioning or refrigeration;

subcooling a second portion of the liquid refrigerant by a substantially constant increment of temperature to a third temperature sufficiently lower than the second temperature to prevent flashing of the second portion of the liquid refrigerant;

boosting the second pressure of the subcooled second portion of the liquid refrigerant to a third pressure greater than the first pressure by a substantially constant increment of pressure; and transmitting the second portion of liquid refrigerant at the third pressure and temperature into the condenser inlet so that the first temperature of the superheated vapor refrigerant is reduced toward the second temperature, thereby reducing the vapor refrigerant to a saturated condition.

19. A method according to claim 18 wherein the boosting step is performed by means of a centrifugal pump.

* * * * *